United States Patent [19]

Mims et al.

[11] Patent Number: 4,532,986

[45] Date of Patent: Aug. 6, 1985

[54] BITUMEN PRODUCTION AND SUBSTRATE STIMULATION WITH FLOW DIVERTER MEANS

[75] Inventors: Donald S. Mims; Richard H. Widmyer, both of Houston, Tex.

[73] Assignee: Texaco Inc., White Plains, N.Y.

[21] Appl. No.: 491,832

[22] Filed: May 5, 1983

[51] Int. Cl.[3] ..... E03B 3/11

[52] U.S. Cl. ..... 166/50; 166/52; 166/191

[58] Field of Search ..... 166/272, 303, 50, 52, 166/191, 127, 77, 72; 299/2; 15/104.15, 104.16–104.19, 104.2

[56] References Cited

U.S. PATENT DOCUMENTS

| | | | |
|---|---|---|---|
| 1,071,016 | 8/1913 | Ahearn | 299/35 |
| 1,611,820 | 12/1926 | Delo | 15/104.19 |
| 1,816,260 | 7/1931 | Lee | 166/50 |
| 2,796,129 | 6/1957 | Brandon | 166/117 |
| 3,032,108 | 5/1962 | Bielstein | 166/191 |
| 3,977,331 | 8/1976 | Clavin | 15/104.17 |
| 4,026,359 | 5/1977 | Closmann | 166/263 |
| 4,133,384 | 1/1979 | Allen et al. | 166/272 |
| 4,368,781 | 1/1983 | Anderson | 166/50 |
| 4,399,865 | 8/1983 | Anderson et al. | 166/303 |

*Primary Examiner*—Stephen J. Novosad
*Assistant Examiner*—Michael Goodwin
*Attorney, Agent, or Firm*—Robert A. Kulason; Robert B. Burns

[57] ABSTRACT

A well completion, and method for recovering heavy hydrocarbons or bitumen from a subterranean formation. The completion includes a well liner which lies in a generally horizontal disposition within a hydrocarbon holding substrate to define the main or primary well. A secondary well which extends to the surface intersects the main well to communicate therewith. Said secondary well includes means to conduct a stream of hot stimulating fluid into the main well. A fluid impervious barrier or flow diverter means positioned within the main well between the injection end and the production end, establishes a pressure differential across the barrier. The barrier urges stimulating agent into the substrate at a desired location, thereby creating a heated path along which the bitumen emulsion flows toward the well's production end. Means is provided in the secondary well to position the impervious barrier from one end of the main well to the other.

6 Claims, 2 Drawing Figures

BITUMEN PRODUCTION AND SUBSTRATE STIMULATION WITH FLOW DIVERTER MEANS

BACKGROUND OF THE INVENTION

In the production of viscous hydrocarbon such as heavy crude and bitumen from tar sands, it is necessary to thoroughly stimulate the viscous material by lessening its viscosity to flowable condition. Thus, the bitumen, in emulsion form, can flow or be withdrawn from the substrate.

Usually thermal stimulation comprises the introduction of a pressurized flow of a heating medium such as steam into the substrate by way of an injection well. In the instance of tar sands, this step, over a period of time, liquefies the bitumen and releases it from its retained condition in the tar sand. It also establishes a pressure front whereby to urge the now flowable hydrocarbons toward one or more spaced apart production wells.

Although the hereinafter described method and apparatus can be applied to the production of either bitumen or heavy crude oil, the following disclosure will define the invention in terms of the production of bitumen from tar sands.

A preferred, and presently used method adapted to viscous hydrocarbon production utilizes a single well which is sequentially heated, and produced to operate on a cyclical principle. More specifically, the substrate surrounding the well is initially preheated under pressure to convert bitumen into flowable condition.

Thereafter, during a soak period, steam is condensed, and heat is absorbed into the substrate thereby causing bitumen emulsion to gravitate toward the lower pressure well and be produced therefrom.

When, over a period of time, the pressure within the substrate becomes depressed, it is necessary to recommence the cycle by the further introduction of a stimulating medium. As a sufficiently high heat and pressure environment is reestablished and bitumen emulsion is again caused to flow, steam injection is discontinued or minimized. Further controlled draining of bitumen emulsion can now be resumed.

This cyclical process can be repeated indefinitely until the area adjacent to the well becomes exhausted of hydrocarbon product. The method is generally referred to as the huff and puff process. It is found to function effectively particularly when the stimulating medium is steam.

In an alternate prior art method of producing hydrocarbons from a substrate, a plurality of vertical wells are drilled in a desired pattern. Thereafter, the stimulating fluid such as steam, under pressure, is injected for a period of time into the substrate by way of a centrally located injector well.

The heated or stimulated area about the well will gradually be widened, thereby establishing an expanding pressure front. The latter urges flowable bitumen emulsion toward the surrounding producing wells. This process is advantageous in that it can be practiced by a continuous, rather than a cyclical introduction of stimulating fluid.

Tar sand deposits generally occur in horizontal layers. It has been found desirable therefore, toward achieving an improved production rate to utilize a generally horizontally disposed well for producing from the layer. However, the nature of the horizontal well mandates that the latter operate on a cyclical basis to realize an appreciable outflow of bitumen emulsion.

Since this cyclical operation amounts to disruption of the producing phase, it constitutes a less than desirable expedient.

To increase the rate of production from a horizontal well of the type contemplated, there is presently provided an efficient method and apparatus for establishing a flowable bitumen emulsion in and through a tar sand environment. The process is effectuated through use of an elongated, horizontal well which traverses at least a portion of the tar sands layer.

A vertical well is positioned to intersect the horizontal well, and serves to facilitate the producing process as well as to provide communication with the horizontal well.

Operationally, both the horizontal well and the adjacent substrate are initially preheated to establish a favorable operating temperature at which fluidized bitumen emulsion can flow. The horizontal well liner embodies a liner which includes a reciprocally, longitudinally adjustable barrier means therein to divert the stimulating steam outwardly and thereby create a pattern of hot paths along which subsequent bitumen emulsion flows. Said hot paths communicate the relatively high pressured injection area where the stimulating fluid is introduced, with a lower pressure area of the liner through which production takes place.

Thereafter, and subsequent to the preheating step, the well is produced by the controlled introduction of hot stimulating fluid as needed. This latter introduction, together with regulation of the well back pressure, causes fluidized bitumen emulsion to be urged to the well producing end.

As one area of the adjacent substrate becomes depleted of bitumen, the steam flow path pattern is altered by adjusting the location of the steam diverting barrier along the well liner. Thus, the area about the horizontal well is swept thoroughly and efficiently of contained bitumen.

It is therefore an object of the notion to provide the method and apparatus for improving production output of a viscous hydrocarbon fluid from a subterranean reservoir in which the fluid is locked. A further object is to provide a method and apparatus for thermally stimulating and producing a well aligned substantially horizontally within a formation which contains a relatively viscous hydrocarbon, which well includes means for diverting the flow of a stimulating medium to improve the well's efficiency. A still further object is to provide a method and apparatus for the continuous production of viscous hydrocarbon fluids from a main well disposed substantially horizontally through a bitumen holding formation, which main well cooperates with a secondary well and includes means for selectively diverting a stimulating medium flow into the substrate.

Figure 1:
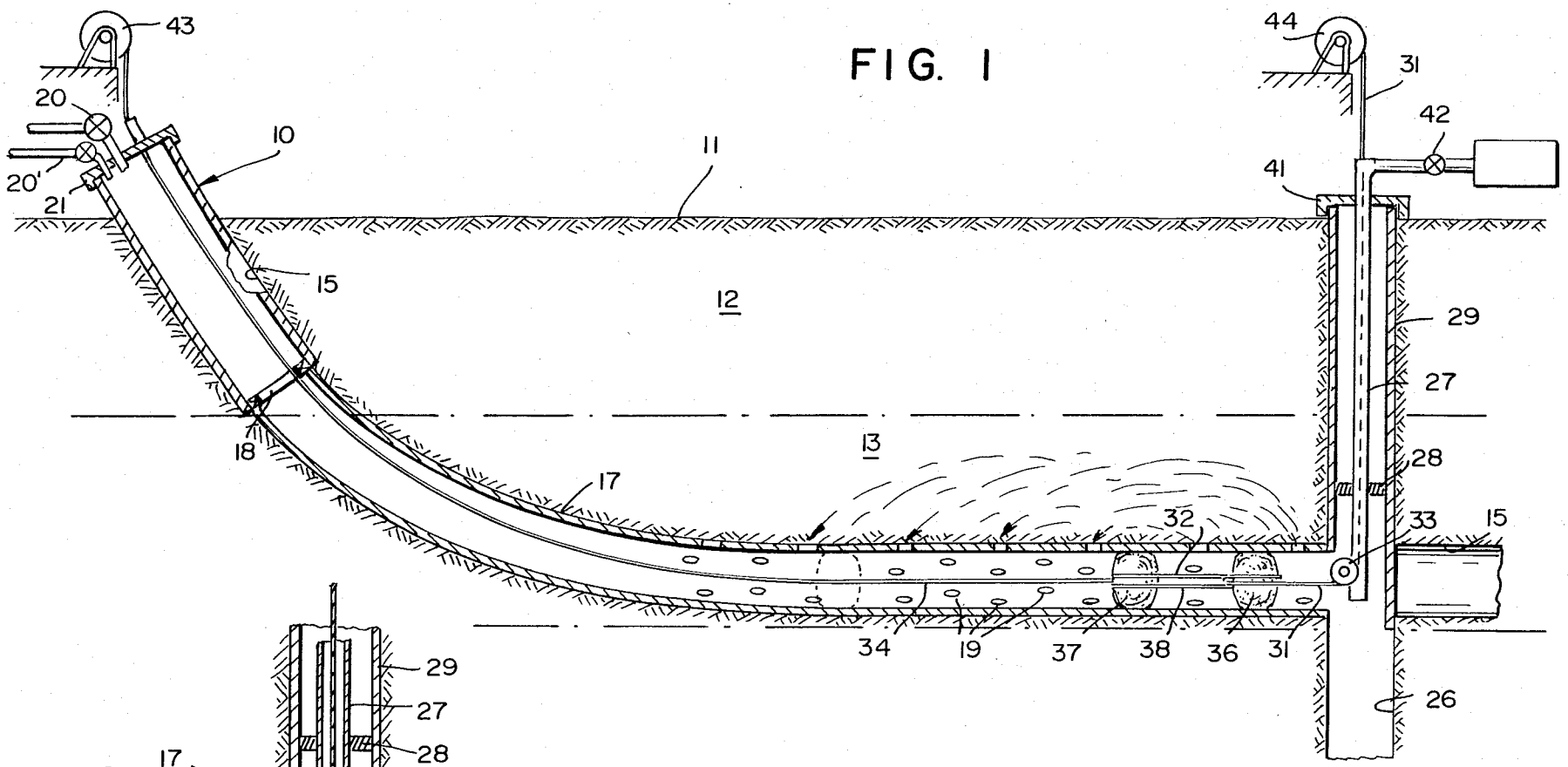
FIG. 1 is an elevation view in cross-section showing a well completion of the type contemplated.

Referring to the drawings, a well 10 of the type contemplated is shown, which can enter the ground at a vertical or near vertical alignment. Preferably the well is disposed at an angle to the ground surface 11. The well bore 14 is initially commenced through overburden 12 which overlies the productive or tar sand layer 13.

Thereafter, partway through the overburden layer the well bore is deviated from its original direction in a manner that at least a segment of it lies in a generally horizontal relationship with respect to the earth surface 11. Preferably the well bore extends coextensively with the tar sand layer. Further, it is preferably positioned at such a depth as to be adjacent to the lower border of the hydrocarbon containing layer 13.

Following usual drilling and completion practice, well bore 14 is provided at the upper end with a series of casing lengths 16. The latter can progressively decrease in size and are grouted in a manner best suited to the condition.

An elongated liner 17 is inserted through the respective casing 16, being supported at the lower end of casing 16 by a liner hanger 18. The latter is structured to allow passage of hot bitumen emulsion therethrough during the producing stage.

Structurally, one embodiment of elongated liner 17 comprises a steel tubular member which is perforated along that portion thereof which lies within tar sand layer 13. The perforation 19 in the liner wall can embody ordinary holes, or alternately slotted openings which extend either horizontally, or circumferentially through the liner wall.

In any event, liner openings 19 are sufficiently large in diameter to permit a pressurized discharge of heating medium therethrough and into the tar sand substrate 13. Further, these openings 19 allow the return flow of hot bitumen emulsion thereto when the latter is in flowable condition.

The upper or external end of liner 17 is provided with a closure such as a well head 21. The latter includes a series of valves 22 and 23 which are operable to regulate the flow of the heating medium flowing into the well, as well as to maintain a desired pressure within liner 17.

Horizontal well 10 can extend for a desired distance through the tar sand layer 13 to a length at which it might effectively operate.

At the remote or buried end of horizontal well 10, a second well 26 is formed. Said second well is located such that it intersects first well 10 in the region of the far end thereof. Second well 26 is presently shown and described as being in a substantially vertical alignment relative to surface 11. It can however be inserted into substrate 12 at an angle to intercept the first well 10's region at a predetermined desired angle.

Second well 26 includes a liner or casing 29 which extends therethrough to terminate approximately at the intersection region of the two well bores. A fluid conductor or conduit 27 is positioned within second well 26. The latter comprises primarily an elongated tube-like member having a packer 28 at the lower end thereof. Packer 28 is operable to expand and engage the adjacent wall of casing 29 whereby to form a fluid tight seal with the latter and to avoid back flow of heating fluid which is discharged from conduit 27.

Well 10 is provided with barrier means assembly 31, such as a bridge plug. Said barrier means 31, functions to block, and divert a flow of heating fluid which enters horizontal liner 17, outwardly and into the substrate 13.

Barrier, or flow diverter means 31 as shown, comprises in one embodiment an axially elongatable or expandable member 32 having two or more outwardly expandable barrier elements 36 and 37, such as two or more bridge plugs at opposed ends thereof. Said barrier elements 36 and 37 are of the type often associated with well treatment procedures. Functionally, they can, when actuated, expand outwardly to engage adjacent liner walls. Each diverter then forms a transverse barrier in the liner 17 to segregate a section of the well whereby to avoid entry of stimulating fluid thereinto. The barrier 31 is connected to or removably engaged with barrier 34 setting conduit, which, although not presently shown, extends from a controllable source of a fluid at the surface, to the respective expandable members 36 and 37. The latter can embody a conductor. Said conduit is capable of carrying an activating fluid to the latter thereby to controllably adjust said members between expanded and contracted positions.

Operationally, by longitudinally adjusting the position of barrier assembly 31, the latter can be urged through the liner 17 in any direction, as needed. At the commencement of a producing operation, preferably barrier 31 is initially positioned at the remote end of liner 17.

Hot stimulating fluid can thus be introduced by way of conduit 27 to horizontal liner 17, and thence diverted into the surrounding substrate 13. This initial application of heat is achieved either by injection through well head 21 at the horizontal well, or preferably through conduit 27 in well 26.

The latter as shown includes a cap 41 through which conduit 27 passes, and which embodies a flow control valve 42. When conduit 27 is communicated to a source of pressurized steam or stimulating fluid at 43, flow of the latter toward well 10 can be readily regulated either for preheating the substrate or for producing.

In a preferred operation, hot stimulating fluid such as pressurized steam will flow initially from conductor 27, into horizontal well 10 at the injection segment of the well as defined by the fixedly positioned barrier 31. The steam will thus be diverted under pressure, into the surrounding substrate 13. Over a period of time it will form a heated progressively expanding stimulated volume.

During this initial heating period, steam will condense to hot water, which in turn will contact the liquefied hydrocarbon or bitumen to form a flowable emulsion, or more accurately, a flowable mixture.

Since the stimulant is injected under a pressure, usually of about 300 psi, the hot stimulating fluid will tend to form pathways through the substrate merely by liquefying the bitumen to flowable state. The presence of fluid barrier or diverter 31 within horizontal well 10 in effect divides the latter into two discrete segments. One of the segments at the injection end will ordinarily be subject to a higher pressure than the downstream or producing segment. Thus, as liquefied bitumen forms into an emulsion or mixture, it will move toward the lower pressure end of well 10 and thereby enter liner 17 through ports 19.

By maintaining the position of barrier 31, and with the continued injection of steam, a steady flow of bitumen emulsion will pass into the production end of liner 17.

The production rate of bitumen emulsion can be facilitated and controlled by adjusting the pressure at well head 21. More specifically the rate of production can be altered by adjusting the back pressure through valves 22 and 23 at well head 21. Thus the flow of the hot bitumen emulsion can be encouraged by reducing the pressure in liner 17 even to the point of establishing a vacuum therein.

Over a period of time, the establishment of the bitumen flow path through the tar sand substrate 13 will exhaust that particular area of available bitumen. It is desirable, and even necessary therefore to adjust the flow paths which communicate the liner producing and injection ends. This is achieved by causing or forcing hot stimulating fluid to enter an area not heretofore fully contacted.

Physically this is done by adjusting the position of the barrier 31 within the longitudinal well 10. More particularly it is effectuated by displacing barrier 31 from its original position, toward the well producing end. Alternatively it is possible to insert another barrier into liner 17 at a position closer to well head 21 thereby in effect extending the barrier length.

Thereafter, further injection of steam into conductor 27 and well 10 will cause movement of the stimulating fluid into heretofore unaffected areas of substrate 13. Overall, the stimulated area of layer 13 will be progressed toward well head 21, thereby further releasing additional bitumen and establishing a new flow path for emulsion to enter liner 17.

After a period of operation, the rate of production at well head 21 will indicate that the section of layer 13 being drained, has been substantially depleted. Barrier 31 can then again be repositioned in either direction along line 17 and a further set of flow paths established or extended into new areas.

To facilitate the controlled reciprocal movement of barrier assembly 31, the latter as noted is provided in one embodiment, with a surface operated cable system. Said system, together with suitable packer actuating conduits, permits the respective packers or barrier elements 36 and 37 to be adjusted to the contracted position and pulled to a desired location. Thereafter reactivation of the packers to an expanded condition fixes the barrier assembly within liner 17.

The shown cable system which is capable of sliding barrier assembly 31 in either direction through liner 17 can comprise a number of cables to achieve the desired function.

For example, to operate most efficiently, each packer 36 and 37 is so connected to the cable system such that each thereof can be positioned independently of the other. However, in that both packers 36 and 37 are under particular circumstances adjusted simultaneously, they can be mutually connected in such manner as to be moved concurrently by the cable system.

Figure 2:
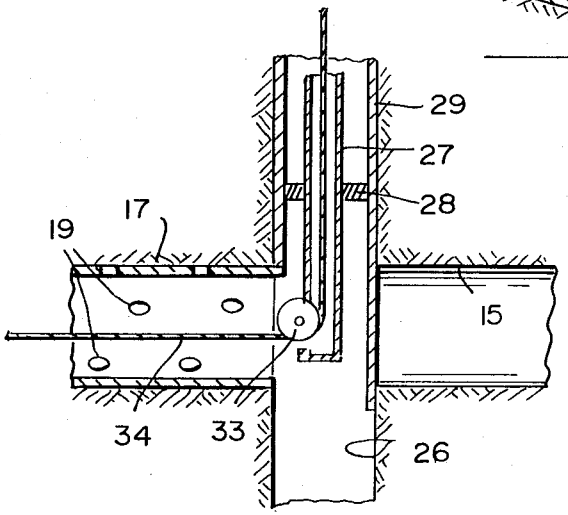
FIG. 2 is an enlarged segmentary view of a part of FIG. 1.

In one operable cable system, cable 38 which is attached to one end of barrier assembly 31 is guided through liner 17 and thence through conductor 27 by means of a spool 39. The latter as shown in FIG. 2 can be rotatably mounted directly to conduit 27 in a manner to allow unhampered movement of the spool and yet permit the free passage of stimulating fluid. The latter as noted is conducted from the source 43, through control valve 42, and downwardly through said conductor and into liner 17.

At the surface, cable 38 is passed through a packing gland or similar fluid tight member within conduit 27 such that the cable can be mounted to a cable take-up mechanism 44. The cable other end 35 is connected to the well head end of barrier means 31, and thence to a second cable take-up mechanism 46.

It is clear from the disclosed arrangement that it is possible, through the selective manipulation of the cables 34 and 38, to regulate the position of barrier 31 anywhere along the length of liner 17.

Thereafter, by the timed movement of barrier means 31, together with introduction of hot stimulating fluid, the rate of bitumen production can be maximized. Further, a higher degree of efficiency can be realized since a more expanded area of the substrate will be swept by the stimulating fluid.

Operationally, barrier 31 can be moved at will in either direction through liner 17. Further, it can be expanded or retracted axially within limitation, thereby to vary the barrier length. Thus, entire lengths of liner 17 can be readily exposed to the most effective injection program.

Although modifications and variations of the invention can be made without departing from the spirit and scope thereof, only such limitations should be imposed as are indicated in the appended claims.

We claim:

1. Well completion for a substrate layer holding viscous hydrocarbons which are produced in response to thermal stimulation of the substrate through the injection of a hot stimulating fluid therein, which completion includes;

an elongated well liner at least a portion of which is disposed in a first well bore formed within the substrate, said at least portion of said elongated well liner being perforated and extending in a substantially horizontal alignment through said substrate layer to receive a flow of hydrocarbon emulsion, and having a well head forming a liner production end, at least one secondary well in the substrate and terminating with its lower end in a region adjacent to a portion of the first well bore, a substrate stimulating system including; a conduit means in said at least one secondary well which is adapted at one end to communicate with a source of a hot pressurized stimulating fluid, said conduit means other end opening adjacent to the first well bore whereby to introduce a pressurized flow of the hot stimulating fluid into the liner remote end, flow diverter means movably positioned within said well liner and being actuatable between expanded and contracted modes to form a transverse barrier in the liner and to interrupt fluid flow therethrough, flow diverter positioning means engaging said diverter means and being operable to controllably adjust the diverter means' location along the liner length thereby to alter the flow of stimulating fluid into the substrate, said flow diverter positioning means includes;

a discontinuous cable means extending through the respective first well bore and secondary well, and being connected to opposed ends of the diverter means whereby to reciprocally adjust the location of the diverter means within said liner and means to separately apply tension to the cable means in one of said wells while concurrently reducing tension to the cable means in the other well said discontinuous cable means being registered within said conduit means in said secondary well.

2. In the apparatus as defined in claim 1, wherein said diverter means includes;

at least two spaced apart members, each being individually expandable within the well liner to form spaced apart fluid tight seals with said elongated liner wall.

3. In the apparatus as defined in claim 2, wherein each of said at least two spaced apart members is connected to the cable means and operably connected to each other to be concurrently or independently adjusted within the elongated liner.

4. In the apparatus as defined in claim 2, wherein each of said at least two spaced apart members is separately connected to one segment of the discontinuous cable means, and adapted to be selectively located within the liner independently of the other of said spaced apart members.

5. In the apparatus as defined in claim 1 wherein said flow diverter positioning means includes; said fluid conduit means (27) in said secondary well being communicated with a pressurized source (43) of steam and a spool (39) at the conduit (27) lower end adjacent to said first wellbore, and said discontinuous cable means within said conduit being registered in said spool (39).

6. In the apparatus as defined in claim 5 including; sealing means (28) carried at the lower end of said fluid conduit means (27) being expandable to form an annular seal with said casing (29) in said secondary well.

* * * * *